US006174160B1

(12) United States Patent
Lee et al.

(10) Patent No.: US 6,174,160 B1
(45) Date of Patent: Jan. 16, 2001

(54) STAGED PREVAPORIZER-PREMIXER

(75) Inventors: John C. Y. Lee, Seattle; Philip C. Malte, Bellevue, both of WA (US)

(73) Assignee: University of Washington, Seattle, WA (US)

( * ) Notice: Under 35 U.S.C. 154(b), the term of this patent shall be extended for 0 days.

(21) Appl. No.: 09/276,251

(22) Filed: Mar. 25, 1999

Related U.S. Application Data

(60) Provisional application No. 60/079,280, filed on Mar. 25, 1998.

(51) Int. Cl.[7] ..... F23D 11/44; F23L 15/00

(52) U.S. Cl. ..... 431/11; 431/8; 431/211; 431/239; 60/736; 60/737; 239/13; 239/427.3; 239/433; 239/8

(58) Field of Search ..... 431/11, 2, 8, 161, 431/163, 165, 207, 210, 211, 219, 238, 239, 10, 346, 190; 60/737, 736, 746; 239/13, 135, 138, 8, 400, 427, 427.3, 428, 433; 222/189.1

(56) References Cited

U.S. PATENT DOCUMENTS

| | | | |
|---|---|---|---|
| 2,315,482 | 3/1943 | Fortis | 431/163 |
| 3,101,773 | 8/1963 | Blaha | 431/238 |
| 3,139,138 | 6/1964 | Bloom | 431/239 |
| 3,250,236 | 5/1966 | Zelinski | 431/238 |
| 3,265,113 | 8/1966 | Thurley et al. | 431/238 |
| 3,925,002 | 12/1975 | Verdouw | 431/10 |
| 3,958,416 | 5/1976 | Hammond, Jr. et al. | 60/39.65 |
| 4,007,002 | 2/1977 | Schrimer | 431/11 |
| 4,057,021 | 11/1977 | Schoppe | 431/11 |

(List continued on next page.)

FOREIGN PATENT DOCUMENTS 1 521 584 * 8/1978 (GB) .

OTHER PUBLICATIONS

Hutzler, M.J., Andersen, A.T., Peabody, G.E. (1996), International Energy Outlook with Projections to 2015, Energy Information Administration, http://www.eiadoe.gov/oiaf/ieo96, Washington, D.C.

Lefebrve, A. H. (1989), Atomization and Sprays, pp. 105–197, Hemisphere, Bristol, P.A.

Schoeberlein,D., Holland, A., and Church, L. (1996), Annual Energy Outlook 1997 with Projections to 1997, Energy Information Administration, http://www.eia.doe-.gov/oiaf/aeo97/eleprice.html, Washington, D.C.

Swanekamp, R. (1996), "Fuel Management: Natural Gas/Fuel Oil, " Power, vol. 140, No. 1, pp. 11–18.

*Primary Examiner*—Carl D. Price
*Assistant Examiner*—Josiah C. Cocks
(74) *Attorney, Agent, or Firm*—Kathleen T. Petrich

(57) ABSTRACT

Method and apparatus to prevaporize and premix liquid and/or gaseous fuels with air in two stages at two different temperatures prior to combustion. The invention is directed to the entry of a finely atomized liquid fuel, such as No. 2 diesel, into an inlet end of an annular chamber. Air is mixed with finely atomized liquid fuel, preferably generated by a small flow number liquid fuel nozzle, in a first chamber of the annular chamber at a first (relatively high) temperature for a relatively long residence time. The air and liquid fuel is moved into a second chamber of the annular chamber where a secondary hotter air is injected into the annular chamber by a plurality of staggered high velocity jets to prevaporize and premix the combined fuel and air mixture at a second higher temperature, but for a shorter time. The intense prevaporization and premixing make the mixture suitable for entry into a combustor, but without the need to add water or steam to keep pollutant emissions low. Alternatively, the invention may be used with a gaseous fuel and air, or the combination of liquid fuel and gaseous fuel and air. A sharp-edged film atomizer may be added to provide secondary atomization of the liquid fuel.

45 Claims, 2 Drawing Sheets

U.S. PATENT DOCUMENTS

| | | | | |
|---|---|---|---|---|
| 4,365,952 | | 12/1982 | Ohmukai et al. | 431/239 |
| 4,375,954 | | 3/1983 | Trudel | 431/11 |
| 4,429,527 | | 2/1984 | Teets | 60/39.06 |
| 4,698,014 | | 10/1987 | Grethe et al. | 431/11 |
| 4,890,793 | * | 1/1990 | Fuglistaller et al. | 239/427 |
| 5,143,297 | * | 9/1992 | De Michele et al. | 239/427 |
| 5,295,352 | | 3/1994 | Beebe et al. | 60/39.06 |
| 5,505,045 | * | 4/1996 | Lee et al. | 60/748 |
| 5,647,538 | | 7/1997 | Richardson | 239/405 |

* cited by examiner 10
12
14
16
18
20
22
24
26
28
30
32
34
36
38
46
48
50
52
54
58
61
64
66
68
70
71
72
74
76/78
76/80

STAGED PREVAPORIZER-PREMIXER

RELATED APPLICATION

This application claims priority to U.S. provisional application, Ser. No. 60/079,280, filed Mar. 25, 1998, and entitled "Staged Prevaporizer-Premixer," which is hereby incorporated in its entirety by reference.

TECHNICAL FIELD

The present invention relates to a device used in connection with combustion systems that burn liquid and gaseous fuels. More particularly, the present invention is directed to a method and device in which fuel and air are prevaporized and premixed in two stages prior to the onset of combustion in order to minimize pollutant emissions, coking, flashback, and autoignition.

BACKGROUND OF THE INVENTION

Both gaseous and liquid fuels are burned in gas turbine engines used to drive electrical generators and mechanical equipment. Liquid fuels are burned exclusively in gas turbine engines used for aeronautical applications. Over the past ten years, the lean-premixed (LP) combustor has been developed and is now the accepted device for burning natural gas in gas turbine engines. It is economical and meets most environmental regulations.

Although many gas turbines run predominately on natural gas, their combustor must have the ability to cleanly and efficiently burn oil or other liquid fuels during the coldest part of the year, since nearly all sites are on interruptible natural gas service. Additionally, for some sites, liquid fuel is the fuel of choice for year-round use. And, as mentioned above, liquid fuel is the only fuel consumed in aeronautical gas turbine engines.

Liquid fuel combustors for gas turbines are not as advanced as LP combustors for natural gas. Consequently, pollutant emissions are significantly greater for liquid fuel firing than for gaseous fuel firing. Most liquid fuel combustors are non-premixed (the fuel and air enter the combustor separately). In order to overcome the problem of high emissions, the gas turbine industry is developing lean, prevaporized, and premixed (LPP) combustors. Thus, the device that provides the prevaporized-premixed fuel and air mixture to the flame (combustor) is very important.

Number 2 diesel fuel is the preferred liquid fuel for may gas turbine engines. Kerosene and JP fuels are used in aero engines. In addition, under certain circumstances, light distillates (i.e. naphtha) and/or heavy distillates or residual fuel oil are used as the fuel. Fuel preference depends on availability and on economical and geo-political factors. For example, in Asia, a mixture of both LP and LPP combustion turbines is in heavy demand, but a large variation in fuel availability and demand exists.

Environmental impact from the use of gas turbines is considered to be one of the lowest compared to other combustion devices. Nevertheless, environmental awareness has prompted regulatory agencies throughout the world to place increasingly stringent requirements on the reduction of both gaseous and particulate pollutant emissions from gas turbines.

Pollutant emissions from the combustion of liquid and gaseous fuels in gas turbines mainly consist of nitrogen oxides ($NO_x$), carbon monoxide (CO), and particulates (e.g. soot and sulfate particulates). Emissions from LP combustors running on natural gas are generally low and are controlled by the lean-premixed combustion process. Emissions under 10 ppmv (parts per million by volume) are obtained for some LP combustion gas turbines. On the other hand, for liquid fuel fired gas turbines, water or steam injection is required to reduce the $NO_x$ emissions to about 40 ppmv, a practice many wish to avoid because of inconvenience, cost of providing very clean water to the engine, and degradation of the engine. The state of the U.S. technology on LPP combustors is such that emissions under 70 ppmv of $NO_x$ are difficult to obtain.

In an LPP combustion system, a prevaporization process is employed to vaporize and premix the fuel and air before the fuel and air enter the combustor. In actuality, current LPP gas turbine designs can only partially prevaporize the liquid fuel before it is introduced into the combustor. Because the fuel is only partially prevaporized, it cannot be completely premixed at the molecular level with the air prior to combustion. Consequently, flame temperature and $NO_x$ formation rates are higher than for the case of completely prevaporized-premixed combustion. For this particular reason, water or steam is injected into the combustor primary zone to reduce and control the formation of the oxides of nitrogen. As noted above, the additional requirement of a water or steam injection system increases the capital, operating, and maintenance costs of the LPP gas turbines.

Prior art has attempted to address prevaporizer-premixers for combustors that reduce noxious emissions, such as Richardson, U.S. Pat. No. 5,647,538, granted Jul. 15, 1997, and entitled "Gas Turbine Engine Fuel Injection Apparatus"; Beebe et al., U.S. Pat. No. 5,295,352, granted Mar. 22, 1994, and entitled "Dual Fuel Injector With Premixing Capability For Low Emissions Combustion"; Teets, U.S. Pat. No. 4,429,527, granted Feb. 7, 1984, and entitled "Turbine Engine With Combustor Premix System"; Hammond, Jr. et al., U.S. Pat. No. 5,3958,416, granted May 25, 1976, and entitled "Combustion Apparatus"; and Verdouw, U.S. Pat. No. 3,925,002, granted Dec. 9, 1975, and entitled "Air Preheating Combustion Apparatus." However, all of these patents are directed to single stage premixers, meaning there are not two sources of air temperatures, to more fully prevaporize and premix the fuel for optimum performance and reduced pollutant emissions. Although Teets addresses two "stages," it is not a true two stage prevaporizer-premixer as there is no addition of higher temperature air to fully prevaporize and premix the fuel and air.

Additionally, the prior art does not address the problem of coking as the liquid fuel is sprayed or otherwise discharged onto the hot metal surface of the premixer during the atomization and vaporization process. Coking, which is the oxidative pyrolysis of the parent fuel molecule into smaller organic compounds and its eventual transformation into solid carbon particles, is undesirable since it leads to deposition of solid carbon particles on hot surfaces, which eventually leads to flow disruption. The rate of deposition (i.e. coke formation) is dependent on the (wall) surface temperature, fuel temperature, pressure, and fuel type. In particular, it is strongly influenced by (wall) surface and fuel temperature. The range in which coking can be a problem is 400 K and above, which is the temperature range at which most premixers operate.

An object of the present invention is to provide a two stage prevaporizing and premixing process without the need to add water or steam to reduce pollutant emissions. Another object of the present invention is to mitigate coking by keeping the liquid fuel away from hot surfaces. Another object of the present invention is to mitigate flashback (that is the propagation of the flame back into the premixer).

SUMMARY OF THE INVENTION

The present invention relates to a method and device for prevaporizing and premixing fuel and air in two stages with two temperatures for optimum combustibility and mitigation of pollutant emissions.

The method is directed to prevaporizing and premixing fuel and air into a lean prevaporized-premixed mixture for ignition in a combustor. The method includes the steps of first providing an inlet flow of air at a first stage temperature into a first stage chamber of an annular chamber. The annular chamber includes both an inlet and an outlet. The annular chamber also defines a second stage chamber that is coannular and contiguous with the first stage chamber.

Next, a fuel is introduced into the first stage chamber. The fuel is atomized into the first stage chamber. The inlet flow of air and fuel are mixed in the first stage chamber at the first stage temperature for a first stage residence time, thereby, forming a resulting fuel and air mixture that flows into the second stage chamber.

Next, secondary air is introduced into the second stage chamber at a second stage temperature, which is higher than that of the first stage temperature. The secondary air is mixed with the fuel and air mixture from the first stage chamber in the second stage chamber for a second stage residence time, which is shorter than that of the first stage residence time, until the resulting mixture is at a desired prevaporization and premixing level for combustion.

Last, the prevaporized-premixed fuel and air mixture is directed out of the annular chamber through the outlet toward the combustor.

The level of desired prevaporization and premixing will depend on many parameters, none the least is the type of fuel used. Although No. 2 diesel is a common liquid fuel used in combustion, other fuels, liquid and/or gaseous fuels, can be used as well.

According to one aspect of the invention, the method is directed to the mixing of liquid fuel and air. Preferably, here, there is the extra step of providing a small flow number liquid fuel nozzle for extremely fine atomizing of the liquid fuel. In another aspect of the method, a secondary atomizer, such as a sharp-edged film atomizer, may be added to secondarily atomize larger droplets from the small flow number liquid fuel nozzle.

According to another method of the invention, the inlet and outlet of the annular chamber are axially aligned along an imaginary centerline of the annular chamber. The liquid fuel nozzle and optional sharp-edged film atomizer may also be coaxial with the inlet and outlet and generated about the centerline. Thus, the finely atomized liquid fuel, both in primary and optional secondary atomization, are directed toward the centerline of the annular chamber, and not any surface that defines the annular chamber. This prevention of atomized fuel spraying or otherwise collecting onto any surface defining the annular chamber prevents coking.

According to yet another aspect of the invention, the method may include prevaporizing and premixing both liquid fuel and gaseous fuel and air. Because gaseous fuels do not cause coking, it is not important that the gaseous fuel is introduced in axial alignment with the annular chamber centerline. However, preferably, the gaseous fuel is introduced upstream of where the first stage air is injected into the first stage chamber, which may be a plurality of injection holes.

According to another aspect of the invention, the method may further include a plurality of high velocity jets that may be staggered in their position relative to entering the second chamber. This mixes the higher temperature second stage air with the fuel and air mixture from the first stage. This intense premixing provides optimum prevaporizing and premixing with reduced pollutant emissions without the need for costly injected water or steam to achieve a similar result.

Another aspect of the invention may include the step of providing a diverging-converging nozzle to prevent flashback, which is the flame of the combustor propagating back into the staged prevaporizer-premixer. The shape of the nozzle is essentially two frusto-conically shaped nozzles positioned back-to-back with the larger part of the frustum of the diverging nozzle positioned contiguously and adjacent the larger part of the frustum of the converging nozzle.

Although temperature values and residence time will vary depending on the type of fuel used, mass flow rate, area of the chamber, etc., for the benefit of example, the first stage temperature that the liquid fuel is atomized can be in the range of 350–600 Kelvin (K) with the second stage chamber air injected at a higher temperature in the range of 600–1000 K. Also, for the purposes of example, the first relatively long residence time may be in the range of 10–20 milliseconds (ms) and the second relatively short residence time may be in the range of 1–5 ms.

The residence times may be extended (altered) with the addition of at least one extension tube, which increases the volume, in either or both the first or second stage chambers.

Additionally, the present invention is also directed to the device of the staged prevaporizer-premixer or SPP. The SPP includes an annular chamber defining a first stage chamber and contiguous and coannular second stage chamber with an inlet end at one end of the annular chamber adjacent the first stage chamber and the outlet end at the other end of the annular chamber adjacent the second stage chamber. The invention includes a primary liquid fuel atomization assembly located near the inlet end. The primary liquid fuel atomizer finely atomizes an inlet flow of liquid fuel. Air enters the first stage chamber at a relatively low first temperature to prevaporize finely atomized liquid fuel and move the resulting mixture into the second stage chamber.

The second stage chamber includes an air inlet system that is of higher velocity and at a higher temperature than that at the first stage chamber. The higher temperature air mixes the fuel/air mixture that has flowed from the first stage chamber.

The SPP also includes an outlet nozzle to direct the prevaporized and premixed fuel and air mixture to the combustor.

As discussed above in the method, the apparatus may also include a secondary atomization assembly, which is preferably the sharp-edged film atomizer. Additionally, the second air inlet source preferably introduces by a plurality of staggered high velocity jets to mix the hot secondary air with fuel and air mixture from the first stage chamber, as well as other structure discussed in the method claims.

These and other features and benefits will be discussed in further detail in the various figures of the attached drawing, the Brief Description of the Drawing, and the Best Mode for Carrying Out the Invention.

BRIEF DESCRIPTION OF THE DRAWING

Like reference numerals are used to designate like parts throughout the several views of the drawing, wherein.

BEST MODE FOR CARRYING OUT THE INVENTION

Figure 1:
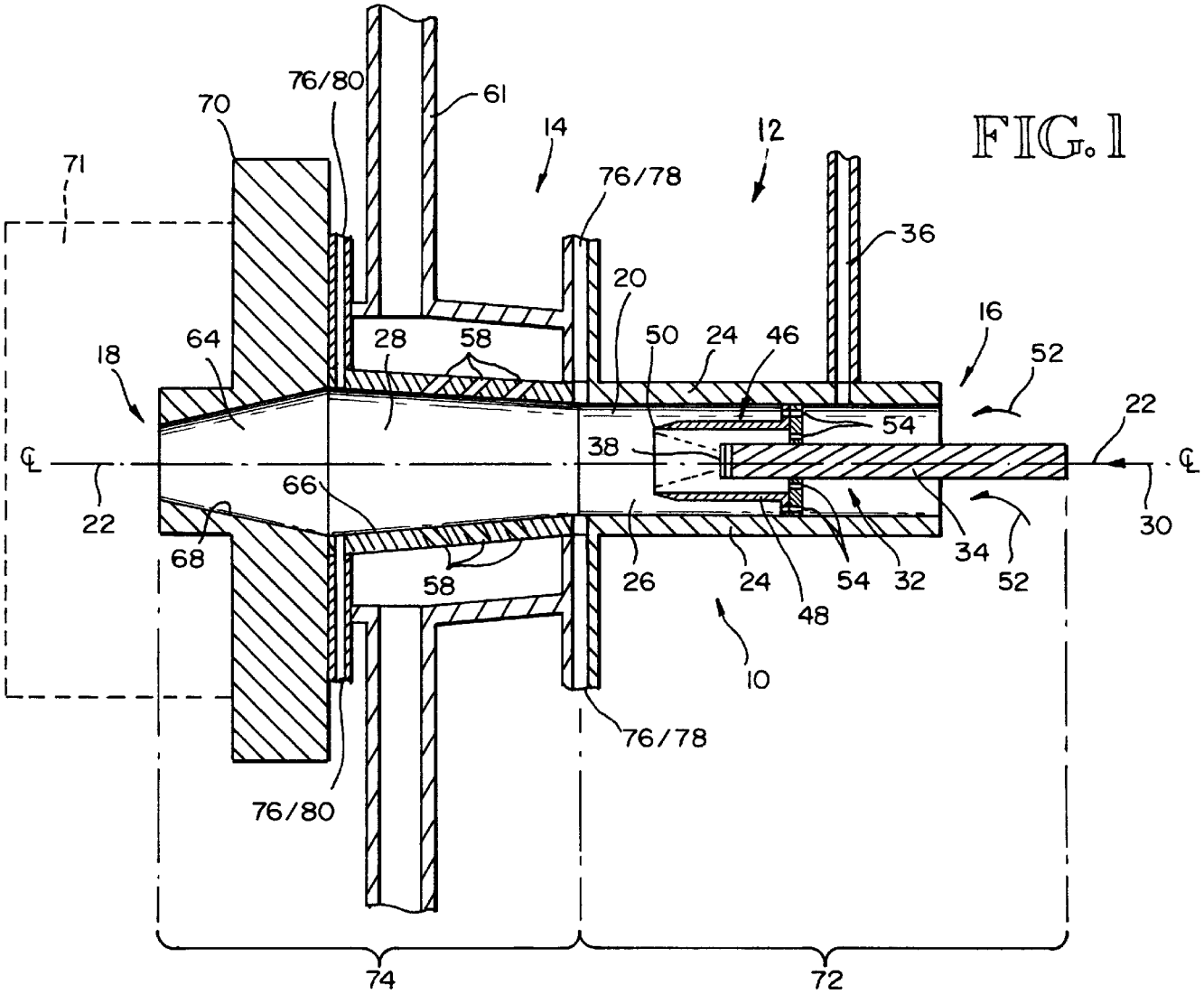
FIG. 1 is a section view of the staged prevaporizer-premixer of the present invention disclosing a first stage portion and a second stage portion.
Figure 2:
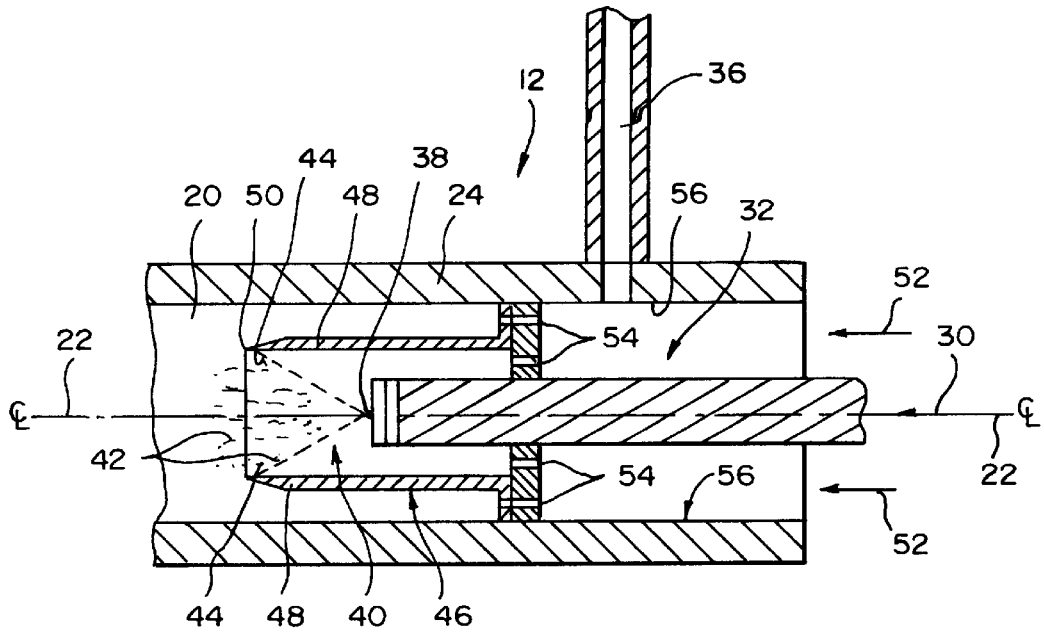
FIG. 2 is an enlarged section view of the first stage portion of FIG. 1 and better showing the liquid fuel nozzle for finely atomizing the liquid fuel in a conical distribution and the secondary atomization shape-edged film atomizer that provides a strong shear force at the lip of the film atomizer for atomization of larger droplets.
Figure 3:
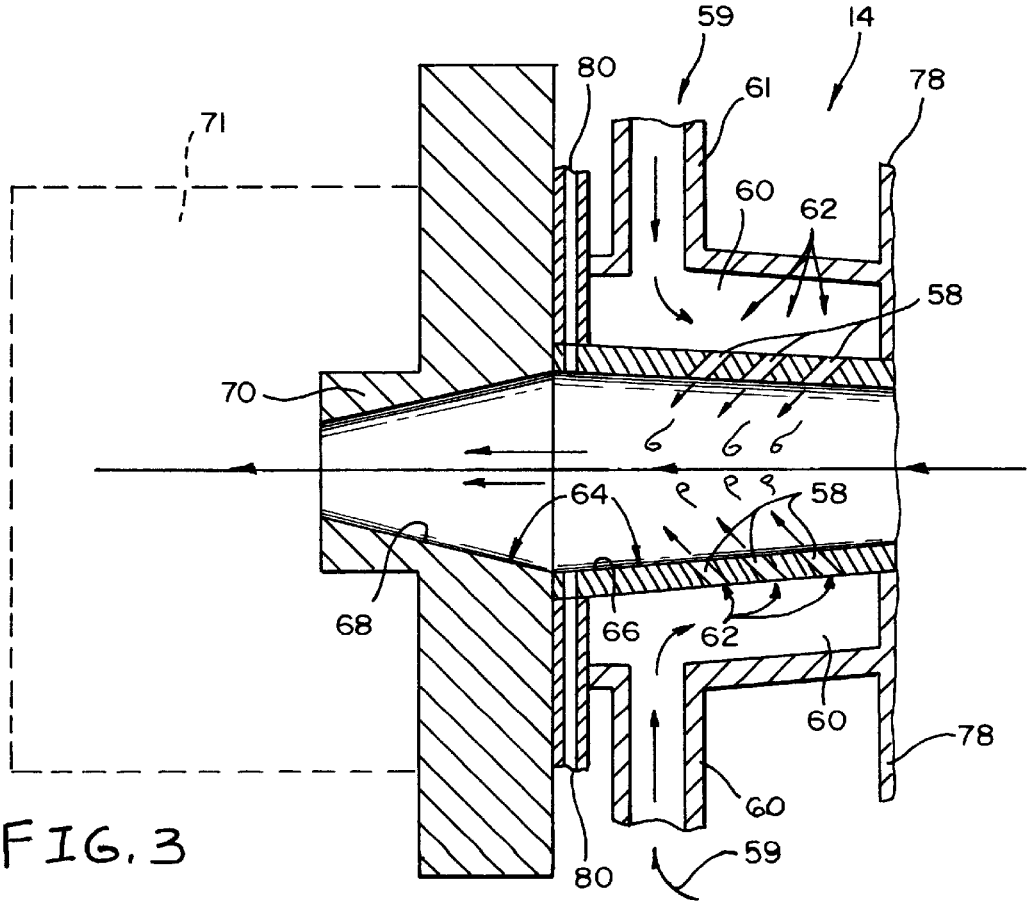
FIG. 3, is an enlarged section of the second stage portion of FIG. 1 and better showing the secondary air inlet entering the second stage chamber in a non-axial aligned direction relative to the fuel flow from the first stage chamber.

Referring to FIGS. 1–3, the present invention is directed to a method and device for prevaporizing and premixing combustible fuel and air prior to combustion in a combustor (not shown). The device is directed to a staged prevaporizer-premixer (SPP) 10. The present invention includes a first stage portion 12 and a second stage portion 14. The importance of each stage portion will be discussed in detail below.

The SPP 10 includes an inlet 16 and an outlet 18. With the inlet 16 and outlet 18 the SPP 10 is essentially an annular chamber 20 with inlet 16 essentially axially aligned with the outlet 18 as shown by centerline 22. The term "annular" as used herein is defined as a contiguous chamber having a cross-section of any cavity shape; as such, a resulting cross section of the annular chamber is not limited to a circle, but may be a square, rectangle, triangle, or any polygonal shape.

The SPP annular chamber 20 is defined by a sidewall 24, which is typically metal as discussed below. The sidewall may be formed by various components and may not be one cohesive sidewall. However, the annular chamber 20 is contiguous and annular essentially from inlet 16 to outlet 18.

Annular chamber 20 defines a first stage chamber 26 and a coannular second stage chamber 28 that is between the inlet 16 and the outlet 18 (as defined herein, "between" is broadly defined to be "in between" and/or inclusive of the inlet and outlet). The first stage chamber 26 is within the first stage portion 12 and the second stage chamber 28 is within the second stage portion 14.

The SPP of the present invention is designed to handle liquid fuel, gaseous fuel, or more, typically, both liquid and gaseous fuels; this is because the industry has standardized on both fuel types. As discussed in the "Background of the Invention," gaseous fuel is more efficient and burns with less undesirable emissions or pollutants. However, liquid fuel is used in many applications, and used almost exclusively in the aeronautical industry. Hence, the SPP 10 is designed to receive liquid fuel axially into the inlet 16 as shown by arrow 30 by a primary liquid fuel atomizer assembly 32, which may be a liquid fuel nozzle 34, positioned into the first stage chamber 26. It is also designed to receive gaseous fuel, such as natural gas, synthetic gas (syngas), propane, hydrogen, town gas, ethane, etc., at gaseous fuel inlet 36, which when received with liquid fuel, is preferably introduced upstream of first stage injection holes 54, which will be discussed below.

While there is a beneficial reason that the liquid fuel flow axially into the first chamber along the centerline, which will be discussed below, gaseous fuel does not need to be axially aligned with the annular chamber. As such, the gaseous fuel inlet 36 may enter in any direction into the first stage chamber. The gaseous fuel inlet is shown entering into the chamber at approximately 90 degrees from the centerline. This is for illustration only and the present invention is not limited to this configuration.

The fuel that is used most frequently in LPP's is No. 2 diesel. The present invention is particularly well suited for this type of fuel, but may be used successfully with other fuels as well.

Referring also to FIG. 2, the liquid fuel nozzle 34, which is generally longitudinally positioned along the imaginary centerline 22, includes a very small flow number having a pinhole sized orifice 38 for finely atomizing the liquid fuel. Although many types of nozzles will suffice, such as a pressure atomizer, air assist, airblast, rotary, etc., the desired result is extremely fine atomization. The orifice 38 sprays the finely atomized fuel in a cone-shaped distribution 40 defined by angle $\alpha$. Finer droplets 42 are directed to the centerline 22, whereas larger droplets 44 are flung outward along the cone-shaped distribution.

Preferably, the invention also includes a secondary atomizer 46 to atomize large droplets 44 from the liquid fuel nozzle 34. The preferred secondary atomizer is a sharp-edged film atomizer, which is also preferably positioned about the centerline 22 such that the large droplets 44 sprayed from orifice 38 are contained by a sharp-edged sidewall 48 of the sharp-edged atomizer 46.

The sharp-edged film atomizer 46, includes a sharp edged lip 50 at the inwardly-directed end edge of the sharp-edged sidewall 48. The lip 50 generates a shear force that atomizes the larger droplets 44 and redirects the now secondarily atomized drops back toward the centerline.

Air is introduced via a supply tube (not shown) into the first chamber coaxially with the liquid fuel nozzle assembly in the direction of arrows 52. This first stage air is split through a plurality of injection holes 54 between the nozzle assembly 32 and the sharp-edged film atomizer 46 between the film atomizer 46 and the inner wall 56 of the first stage chamber 26 (sidewall 24). The split air provides the air required for the cone angle $\alpha$ adjustment and the air required for the film atomization technique. This air is of a relatively low temperature to that of the second stage air, which will be discussed below.

The reason it is desired to keep the atomized fuel spray along the centerline is so that the atomized liquid fuel and air mixture spray will not splash onto the annular chamber sidewall 24. The sidewall is typically at a sufficiently hot temperature level that vaporization and mixing can be conducted on the hot surface if the spray is subjected to the surface. However, this vapolization at the surface could coke (build up of carbon) at the surface, which is very undesirable as discussed in the "Background of the Invention."

Referring particularly to FIG. 3, in the second stage portion 14, a plurality of axially-offset, high velocity, mixing jets 58 provide a secondary hot air source (shown schematically at arrows 59) for improved prevaporization and premixing the atomized liquid fuel/air mixture that has flowed from the first stage chamber 26 to the second stage chamber 28. This is accomplished by injecting hot air into an outer passageway 60 through supply tubes 61. The hot air is designed to flow in the reverse direction as shown by arrows 62 and is introduced into the main fuel/air flow by the jets 58. The hot secondary air is preferably not injected axially, but rather non axially-aligned with the fuel/air mixture from the first chamber for improved prevaporizing and premixing. This configuration provides intense fuel and air mixing. In preferred form the mixing jets are staggered (varied flow directions) to aid in the mixing.

The jets are an improvement over the axial swirl vanes of the prior art as the jets better direct the flow, as opposed to the outward flow tendencies of the axial swirlers. This is because the employment of axial swirlers leads to the collection of liquid fuel on the hot premixer walls (collectively noted as sidewall 24) that consequently causes coking. Although axial swirl vanes are not desirable, radial swirl vanes, however, may be a substitute for the jets.

Toward the outlet 18, there is a diverging-converging nozzle 64 that is shaped to prevent hazardous flashback (the flame propagating back into the SPP). The shape of the diverging-converging nozzle may be two substantially back-to-back frustums 66, 68 with the base of each frustum adjacent and contiguous to the other. The converging frustum 68, which is adjacent the combustor (not shown), prevents flashback by continuously accelerating the flow and at the same time prevents flow separation while keeping a favorable pressure gradient. In the diverging frustum 66, the change in cross-sectional area accommodates mass addition (i.e. the secondary air). The degree of divergence is well within the limits of flow separation.

Protecting the diverging-converging nozzle 64 is a front-end high temperature nozzle 70, which connects to the combustor 71. The front-end high temperature nozzle 70 also provides interface between the SPP 10 and the combustor.

Referring to all three FIGS., consistent with the two stage portions is the two stage processing (prevaporizing and premixing) of the fuel(s) prior to combustion, which are aptly named the first stage (designated as 72) and the second stage (designated as 74).

In the first stage, the fuel is processed in a low temperature, typically in the range of 350 to 600 Kelvin (K), for a relatively long residence time such as 10–20 milliseconds (ms). This first stage vaporizes the light-end hydrocarbon components.

In the second stage, the fuel is processed in a high temperature, typically 600–1000 K for a relatively short residence time such as 1–5 ms. The second stage completes final vaporization of heavy hydrocarbon components, which reduces pollutant emissions to tolerable levels, (e.g. significantly under 25 ppmv). There is a direct correlation between the higher second stage temperature and the shorter second stage residence time. If the second stage temperature is 800 K, then the second stage residence time may be 2 ms. However, if the second stage temperature is 1000 K, then the second stage residence time may be less than 1 ms.

The temperatures listed and residence times listed above are sample values only. The actual values will depend on the type of fuel used, the pressure applied, and the amount of prevaporization and premixing desired. The critical limiting factor is the autoignition (spontaneous or self-ignition) point.

There are several design goals that make this invention unique and workable over that of the prior art. The present invention is based on receiving and running a lean mixture under premixed conditions, as opposed to the mixture of fuel disclosed in the afore-mentioned Teets patent. Also, a desired goal is have faster vaporization with the use of a high performance liquid fuel nozzle. The fuel is preferably directed through a finely atomized spray along an axial aligned centerline and into the second stage. Thus, the atomized liquid fuel does not vaporize on the sidewall surface, which if left to vaporize on a hot metal surface can lead to coking.

Once the fuel has reached the desired mixing level, it is desired that the mixture be burned right away in the combustor. It is also optimum to mix the fuel and air mixture quickly and to move it to the combustor. Thus, the non-tortuous mixture path through the first and second stages is an advantage over that of the prior art, such as that disclosed in the afore-mentioned Teets patent.

Residence times can be altered by the addition of extension tubes 76, which provide more volume and, thus, increases residence times. The SPP may include both first stage extension tubes 78 and well as second stage extension tubes 80. This can be particularly useful where the chosen fuel has different vaporization characteristics. For example, diesel has a higher boiling point than gasoline; it would likely benefit with the addition of at least one extension tube, which increases the overall residence time.

Several high temperature resistant materials can be used to construct the SPP. Examples include: 316 stainless steel, any grade of INCONEL alloy, or any grade of HASTELLOY alloy. Additionally, advanced ceramics can be used. The HASTELLOY alloy is an ideal material for the front-end high temperature nozzle due to its contact with the high temperature combustion environment.

One of ordinary skill in the art would know and understand that to monitor and control the various design parameters to add various instruments such as flowmeters to measure mass flow rate, thermocouples for measuring temperature, etc.

Although a non-torturous pathway from inlet to outlet is desired, geometry of the annular chamber is not the important part of the invention. Thus, many shapes may be adopted and not depart from the scope and spirit of the invention.

As described above, the present invention provides prevaporized and premixed fuel and air mixtures to the combustor without the need for added steam or water, with the result of acceptable pollutant emissions. Thus, the present invention is practical without the need for costly steam addition.

Additionally, the present invention can be applied to other combustion systems such as furnaces, boilers and stoves. It is not limited to gas turbine engines and to lean combustion systems. Rather, the idea is pertinent to all combustion applications requiring a high degree of liquid fuel prevaporization and premixing in order to achieve high combustion efficiency and low emissions output. Furthermore, recirculated flue gas or exhausted gas could be substituted for either the primary or secondary air or both air streams.

The illustrated embodiments are only examples of the present invention and, therefore, are non-limitive. It is to be understood that many changes in the particular structure, materials, and features of the invention may be made without departing from the spirit and scope of the invention. The steps of the method claims do not necessarily have to be in the exact order laid out in the claims. Therefore, it is the applicants' intention that its patent rights not be limited by the particular embodiments illustrated and described herein, but rather by the following claims interpreted according to accepted doctrines of claim interpretation, including the doctrine of equivalents and reversal of parts.

What is claimed:

1. A method of staged prevaporizing and premixing fuel and air prior to combustion in a combustor, the method comprising:

providing an inlet flow of air into a first stage chamber of an annular chamber having an inlet and outlet defining a second stage chamber coannular and contiguous to the first stage chamber;

introducing a fuel into the first stage chamber of the annular chamber;

atomizing the fuel into the first stage chamber;

mixing the inlet flow of air and fuel at a first stage temperature for a first stage residence time; wherein the resulting fuel and air mixture is moved by the inlet flow of air into the second stage chamber;

introducing secondary air into the second chamber at a second stage temperature, which is hotter than the first stage temperature;

secondarily mixing the atomized fuel and air mixture that has flowed from the first chamber with the secondary air in the second stage chamber at a second stage temperature, which is at a hotter temperature than the first stage temperature, and for a second stage residence time, which is shorter than the first stage residence time, until the resulting mixture is at a substantially completely prevaporized and premixed level for combustion; and directing the resulting substantially completely premixed and prevaporized fuel and air mixture out the outlet of the annular chamber to the combustor.

2. The method according to claim 1, wherein the fuel is comprised of a liquid fuel.

3. The method according to claim 1, wherein the fuel is comprised of a gaseous fuel.

4. The method according to claim 2, further comprising the steps of:

introducing a gaseous fuel into either the first or second stage chamber of the annular chamber;

mixing the liquid fuel and air from the first chamber and the hotter secondary air from the second chamber with the gaseous fuel in the second stage chamber until the resulting mixture is substantially completed prevaporized and premixed prior to combustion.

5. The method according to claim 4, wherein the gaseous fuel is introduced upstream from where the liquid fuel is introduced.

6. The method according to claim 2, further comprising the step of:

providing a small flow number liquid fuel nozzle for extremely fine atomizing of the liquid fuel.

7. The method according to claim 2, further comprising the step of:

providing secondary atomization of the liquid fuel.

8. The method according to claim 7, wherein the secondary atomization of the liquid fuel is provided by a sharp-edged film atomizer.

9. The method according to claim 1, further comprising the step of:

generating the annular chamber about an imaginary centerline such that the annular chamber is axially aligned from inlet to the outlet.

10. The method according to claim 2, further comprising the step of:

generating the annular chamber about an imaginary centerline such that the annular chamber is axially aligned from inlet to the outlet; and directing the atomized liquid fuel toward the centerline.

11. The method according to claim 7, generating the annular chamber about an imaginary centerline such that the annular chamber is axially aligned from inlet to the outlet;

directing the atomized liquid fuel toward the centerline; and directing the secondary atomizated liquid fuel toward the centerline.

12. The method according to claim 8, generating the annular chamber about an imaginary centerline such that the annular chamber is axially aligned from inlet to the outlet;

directing the atomized liquid fuel toward the centerline; and directing the sharp-edged film atomizer toward the centerline, wherein the sharp-edged film atomizer includes a lip that generates a shear force to secondarily atomize the liquid fuel.

13. The method according to claim 1, wherein the secondary air is introduced by a plurality of high velocity jets.

14. The method according to claim 2, wherein the secondary air is introduced by a plurality of high velocity jets.

15. The method according to claim 13, wherein the high velocity jets are staggered.

16. The method according to claim 14, wherein the high velocity jets are staggered.

17. A method of prevaporizing and premixing fuel and air prior to combustion in a combustor, the method comprising:

providing an inlet flow of air into a first stage chamber of an annular chamber having an inlet and outlet defining a second stage chamber coannular and continuous to the first stage chamber;

introducing a fuel into the fist stage chamber of an annular chamber;

atomizing the fuel into the first stage chamber;

mixing the inlet flow of air and fuel at a first stage temperature for a first stage residence time; wherein the resulting fuel and air mixture is moved by the inlet flow of the air into the second stage chamber;

introducing secondary air into the second chamber at a second temperature, which is higher than the first temperature;

mixing the atomized fuel and air mixture that has flowed from the first chamber with the hotter secondary air in the second stage chamber for a second residence time, which is shorter than that of the first residence time, until the resulting mixture is at a desired prevaporized and premixed level for combustion; and directing the resulting premixed and prevaporized fuel and air mixture out the outlet of the annular chamber to the combustor;

wherein the hotter secondary air is introduced by a plurality of high velocity jets; and wherein the hotter secondary air flows in a reverse direction of the fuel and air mixture from the first chamber.

18. A method of prevaporizing and premixing fuel and air prior to combustion in a combustor, the method comprising:

providing an inlet flow of air into a first stage chamber of an annular chamber having an inlet and outlet defining a second stage chamber coannular and contiguous to the first stage chamber;

introducing a fuel into the first stage chamber of an annular chamber;

atomizing the fuel into the first stage chamber;

mixing the inlet flow of air and fuel at a first stage temperature for a first stage residence time; wherein the resulting fuel and air mixture is moved by the inlet flow of the air into the second stage chamber;

introducing secondary air into the second chamber at a second temperature, which is higher than the first temperature;

mixing the atomized fuel and air mixture that has flowed from the first chamber with the hotter secondary air in the second stage chamber for a second residence time, which is shorter than that of the first residence time, until the resulting mixture is at a desired prevaporized and premixed level for combustion; and directing the resulting premixed and prevaporized fuel and air mixture out the outlet of the annular chamber to the combustor;

wherein the fuel is comprised of a liquid fuel, and wherein the hotter secondary air is introduced by a plurality of high velocity jets, and wherein the hotter secondary air flows in a reverse direction of the fuel and air mixture from the first chamber.

19. The method according to claim 1, further comprising the step of:

a providing diverging-converging nozzle at the outlet of the annular chamber.

20. The method according to claim 8, wherein the secondary air is introduced in a non-axially aligned manner relative to the centerline.

21. The method according to claim 9, wherein the secondary air is introduced in a providing non-axially aligned manner relative to the centerline.

22. The method according to claim 2, further comprising the step of:

a providing diverging-converging nozzle at the outlet of the annular chamber.

23. The method according to claim 1, wherein the first stage temperature is in the range of 350–600 K.

24. The method according to claim 1, wherein the second stage temperature is in the range of 600 to 1000 K.

25. The method according to claim 1, wherein the first stage residence time is in the range of 10–20 ms.

26. The method according to claim 1, wherein the second stage residence time is in the range of 1–5 ms.

27. The method according to claim 2, wherein the first stage temperature is in the range of 350–600 K.

28. The method according to claim 2, wherein the second stage temperature is in the range of 600 to 1000 K.

29. The method according to claim 2, wherein the first stage residence time is in the range of 10–20 ms.

30. The method according to claim 2, wherein the second stage residence time is in the range of 1–5 ms.

31. The method according to claim 2, wherein the first stage temperature is in the range of 350 to 600 K and the first stage residence time is in the range of 10–20 ms.

32. The method according to claim 2, wherein the second stage temperature is in the range of 600 to 1000 K and the second residence time is in the range of 1–5 ms.

33. The method according to claim 2, further comprising the step:

providing at least one extension tube in the first chamber to alter the first stage residence time.

34. The method according to claim 2, further comprising the step of:

providing at least one extension tube in the second chamber to alter the second stage residence time.

35. The method according to claim 2, further comprising the step:

providing at least one extension tube in the first chamber to alter the first stage residence time, and providing at least one extension tube in the second chamber to alter the second stage residence time.

36. A staged prevaporizer-premixer (SPP) for prevaporizing and premixing liquid fuel and air prior to combustion in a combustor, the SPP comprising:

an annular chamber having an inlet end and an outlet end, wherein said annular chamber defines a first stage chamber and a contiguous and coannular second stage chamber;

a liquid fuel inlet and a liquid fuel atomizer assembly positioned at the inlet of the annular chamber for finely atomizing liquid fuel introduced from the liquid fuel inlet in the first chamber of the annular chamber;

an air inlet supply that introduces air into the first chamber for directing the atomized liquid fuel in a desired direction within the annular chamber at a first stage temperature for a first stage residence time;

a secondary air inlet into the secondary chamber, wherein the secondary air is introduced through the secondary inlet providing further prevaporization and premixing of the partially prevaporized and premixed liquid fuel and air mixture from the first stage chamber at a second stage temperature, which is hotter than that of the first stage temperature, and at a second stage residence time, which is less than the first stage residence time, in order to substantially completely prevaporize and premix the fuel and air mixture prior to combustion; and an outlet nozzle to channel the substantially completely prevaporized and premixed fuel and air mixture from the second stage chamber to the adjacent combustor.

37. The SPP according to claim 36 further comprising a gaseous fuel inlet.

38. The SPP according to claim 37, wherein the gaseous fuel inlet is upstream of the at least one air injection hole.

39. The SPP according to claim 36 further comprising a secondary film atomizer.

40. The SPP according to claim 39, wherein the secondary film atomizer is a sharp-edged film atomizer.

41. The SPP according to claim 36, wherein the liquid fuel inlet is a small flow number liquid fuel nozzle.

42. The SPP according to claim 36, wherein the hotter secondary air inlet includes a plurality of high velocity jets.

43. The SPP according to claim 42, wherein the high velocity jets are staggered.

44. The SPP according to claim 36, wherein the annular chamber, first stage chamber, second stage chamber, inlet end and outlet end are axially aligned and generated about a centerline.

45. The SPP according to claim 44, wherein the secondary air inlet introduces secondary air in a non-axially aligned manner relative to the centerline.

* * * * *

UNITED STATES PATENT AND TRADEMARK OFFICE

CERTIFICATE OF CORRECTION

PATENT NO. : 6,174,160 B1
DATED : January 16, 2001
INVENTOR(S) : John C. Y. Lee et al.

It is certified that error appears in the above-identified patent and that said Letters Patent is hereby corrected as shown below:

Please correct the above-identified patent as follows:

Column 1,
Line 8, add: Government Information Statement: This invention was made with government support under grant number 97-01-SR053 awarded by the U.S. Department of Energy. The government may have certain rights in the invention.
Line 46, substitute "may" with -- many --.

Column 2,
Line 35, substitute "U.S. Patent No. 5,3958,416" with -- U.S, Patent No. 3,958,416 --.

Column 3,
Line 64, add -- through -- after "be".

Column 4,
Line 32, add -- a -- before "contiguous".
Line 53, substitute "introduces" with -- is introduced --.

Column 5,
Line 4, substitute "shape-edged" with -- sharp-edged --.

Column 7,
Line 57, add -- to -- after "is".

Signed and Sealed this

Thirteenth Day of November, 2001

*Attest:*

Nicholas P. Godici

NICHOLAS P. GODICI
*Acting Director of the United States Patent and Trademark Office*

*Attesting Officer*